United States Patent [19]

Chang et al.

[11] 4,162,792

[45] Jul. 31, 1979

[54] OBSTACLE GAME

[75] Inventors: Richard S. Chang, Rolling Hills Estates; George J. Klose, Redondo Beach, both of Calif.

[73] Assignee: Mattel, Inc., Hawthorne, Calif.

[21] Appl. No.: 758,605

[22] Filed: Jan. 12, 1977

[51] Int. Cl.[2] ..... A63F 9/00; A63F 9/14

[52] U.S. Cl. ..... 273/85 G; 273/86 B

[58] Field of Search ..... 273/1 E, 85 R, 86 B, 273/130 AB, 131 A, 134 A, 135 A, 136 A, DIG. 28, 1, 85, 86, 130, 131, 134, 135, 136; 235/92 GA

[56] References Cited

U.S. PATENT DOCUMENTS

| | | | |
|---|---|---|---|
| 3,231,276 | 1/1966 | Cooper | 273/1 E X |
| 3,418,729 | 12/1968 | Ravich | 273/131 A X |
| 3,572,711 | 3/1971 | Conklin et al. | 273/86 B |
| 3,778,058 | 12/1973 | Rausch | 273/85 G |
| 3,868,112 | 2/1975 | Avera | 273/85 G X |
| 3,874,669 | 4/1975 | Ariano et al. | 273/85 G |
| 3,895,799 | 7/1975 | Rinne | 273/85 G |
| 4,017,072 | 4/1977 | Kurtz | 273/130 AB X |
| 4,026,555 | 5/1977 | Kirschner et al. | 273/102.2 R X |
| 4,093,223 | 6/1978 | Wilke et al. | 273/85 G X |

FOREIGN PATENT DOCUMENTS

| | | | |
|---|---|---|---|
| 920164 | 1/1973 | Canada | 273/134 A |

OTHER PUBLICATIONS

*Popular Electronics*; "Build Pontronics"; Apr., 1976; pp. 35–44.

*101 Basic Computer Games*; Digital Equipment Corp.; Mar. 1975; pp. 67–71.

*Primary Examiner*—Vance Y. Hum

*Attorney, Agent, or Firm*—John G. Mesaros; Ronald M. Goldman; Max E. Shirk

[57] ABSTRACT

A novel game is disclosed featuring a playing field having at least three lanes and divided into at least six rungs. A gamepiece representing the player may be positioned in any one of the three lanes and is free to move in a first direction from one rung to the next; randomly generated obstacles advance in the opposite direction from rung to rung; the object of the game is for the player to avoid collision with the obstacle or obstacles. Two embodiments of the game are disclosed, the first simulating an automobile race course wherein the player's playing piece represents an automobile in motion and the obstacles represent competitors' cars being passed, in which case the object of the game is to pass a predetermined number of obstacles; and a second embodiment simulating a football playing field, wherein the player's piece represents the running back of the offensive team and the obstacles represent defensive tackles advancing towards the running back, in which case the object is to advance the ball the greatest possible number of yards and eventually score the maximum number of touchdowns. On account of the nature of the present invention, it is possible to implement it electronically with an inexpensive digital display having a relatively low number of discrete display elements.

8 Claims, 7 Drawing Figures

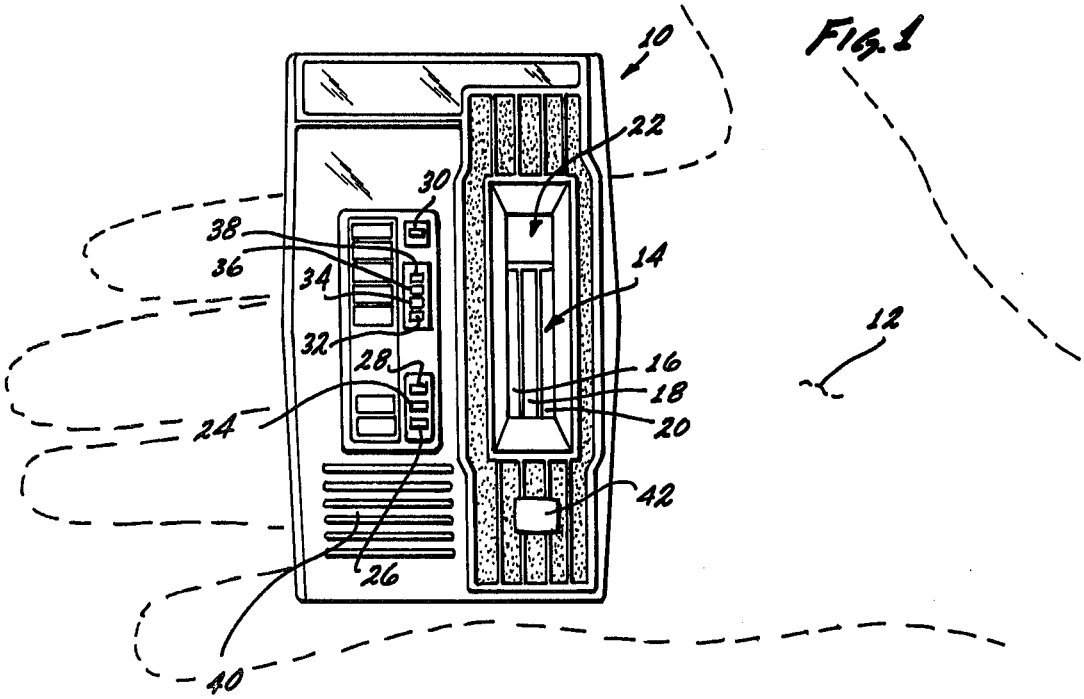
Fig. 1
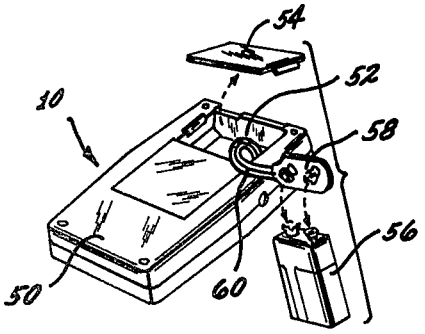
Fig. 2
Fig. 3
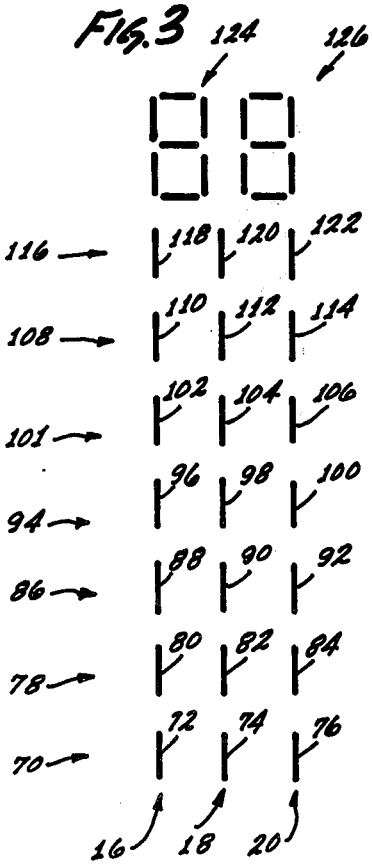

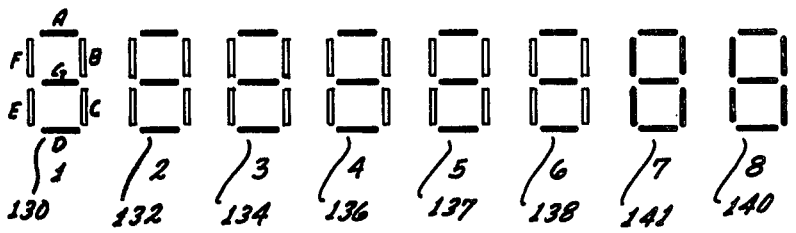
FIG. 4
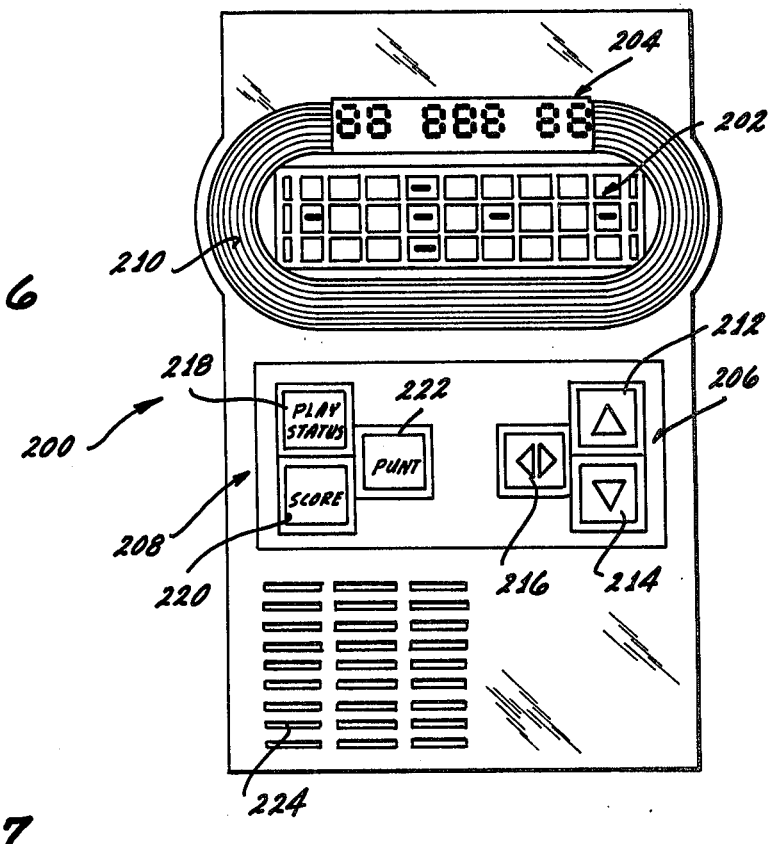
FIG. 6
FIG. 7
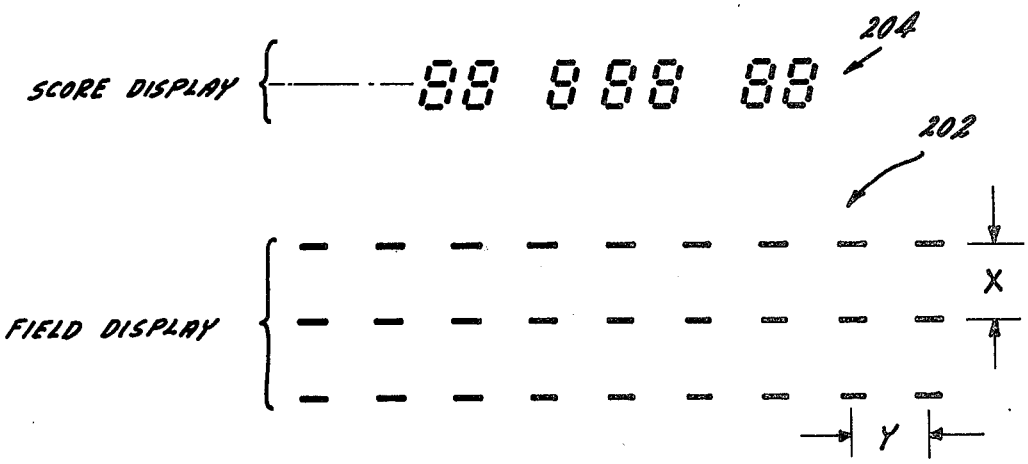

OBSTACLE GAME

BACKGROUND OF THE INVENTION:

The background of the invention will be set forth in two parts.

1. Field of the Invention

This invention pertains generally to games and in particular to mechanical and electronic games wherein the player's skill is directed against a random or pseudo-random algorithm requiring both strategy and tactics, and also quick reaction time.

2 Description of the Prior Art

Games, as best as can be determined, are as old as mankind. Some games, such as roulette, are strictly games of chance. Some games, such as chess, are strictly games of strategy and tactics. Still other games, such as tennis, require in addition to strategy and tactics, physical coordination and timing. More recently there have appeared a number of mechanical games of the amusement parlor type such as Japanese pachinko, various American pinball games, one-arm bandits (or "fruit-machines"), mechanical shooting galleries, simulated auto races, and, more recently, electronic games such as simulated "ping-pong" and tank warfare games wherein the scores and the positions of the various playing pieces (both those controlled by the player and those controlled by the machine) are displayed on a cathode ray tube. Furthermore, the above mentioned amusement parlor games may also incorporate a limited amount of electronic circuitry and/or displays and scoring logic.

The present miniaturized electronics revolution has also been responsible for the appearance of hand-held games such as a calculator which processes stored chess-playing algorithms (such as is briefly described on page 44 of "Electronics Magazine" for Mar. 4, 1976) and an all-electronic roulette wheel using LEDs to represent the spinning balls (such as is described on pages 69 and 70 of the October, 1975 issue of "Popular Electronics Magazine"). The use of liquid crystal display elements is also known in the gaming apparatus art as can be seen from U.S. Pat. No. 3,929,338 in the name of Juergen Peter Busch, while British Patent Specification No. 1,107,552 in the name of Barrington John Leonard White discloses an electronic "fruit machine".

However, the prior art does not disclose any portable electronic game that requires a relatively high degree of skill on the part of the player and yet which do not require costly display apparatus (such as television sets or cathode ray tubes) for the operation of the games.

SUMMARY OF THE INVENTION:

Accordingly, it is one object of the present invention to provide a new class of games which may be manufactured at relatively low cost utilizing present day electronic techniques and which nevertheless provide a high degree of play value.

It is another object of the present invention to provide a simple game which nevertheless requires a high degree of coordination and fast responses on the part of the player.

It is yet another object of the present invention to provide a game requiring a relatively few number of discrete display elements.

It is yet another object of the present invention to provide a relatively inexpensive hand-held game having all of the excitement of the large expensive machines found in amusement parlors.

The invention which satisfies the above and other objects (as will become more clear from the appended drawings and detailed description) may be briefly summarized as a game having a playing field of at least three discrete lanes and at least six discrete rungs with a piece representing the player free to move under the direction of the human operator from any one of said lanes to any other one of said lanes and free to advance in a first direction from one of said rungs to the next of said rungs, with at least one obstacle under machine control being advanced in a second direction opposite said first direction toward said playing piece with the machine having the capability of determining whether or not a "collision" has occurred between the playing piece and the obstacle, suitable scoring means indicating the score of the game as a function of the avoidance of such collision and the motion of the playing piece towards its goal.

In a first described embodiment, the game simulates an automobile race track, with the game being won once a predetermined number of obstacles have been successfully passed.

In a second disclosed embodiment, the game simulates a football playing field in which the playing piece represents a running back carrying the ball and collision with an obstacle represents the successful tackling of the running back, thereby preventing further motion of the playing piece within that down, with the object being to score the maximum possible yardage, and eventually the greatest number of touchdowns.

The latter-described embodiment may be readily transformed into a two-player game wherein control of the ball is passed from one player to the other player upon the scoring of a touchdown or upon four downs having elapsed without sufficient yardage having been gained.

BRIEF DESCRIPTION OF THE DRAWINGS:

For a more thorough understanding of the nature of the present invention and how it may be best practiced by one skilled in the art, reference is made to the following detailed description and the appended figures in which:

FIG. 1 shows a portable electronic embodiment of an auto race game in accordance with the present invention as it is perceived by the player;

FIG. 2 shows in partially exploded perspective view the side and rear of the game of FIG. 1 and the battery contained there;

FIG. 3 is an enlargement of the display portion of the game of FIG. 1 showing the various discrete elements making up the racetrack display and the elapsed time readout provided adjacent thereto;

FIG. 4 shows a lower-cost alternative display to that of FIG. 3;

FIG. 6 shows a two-person football game in accordance with the second embodiment of the present invention.

FIG. 7 is an enlargement of the playing field of FIG. 6 showing the various segments of the electronic display contained therein.

Figure 5:
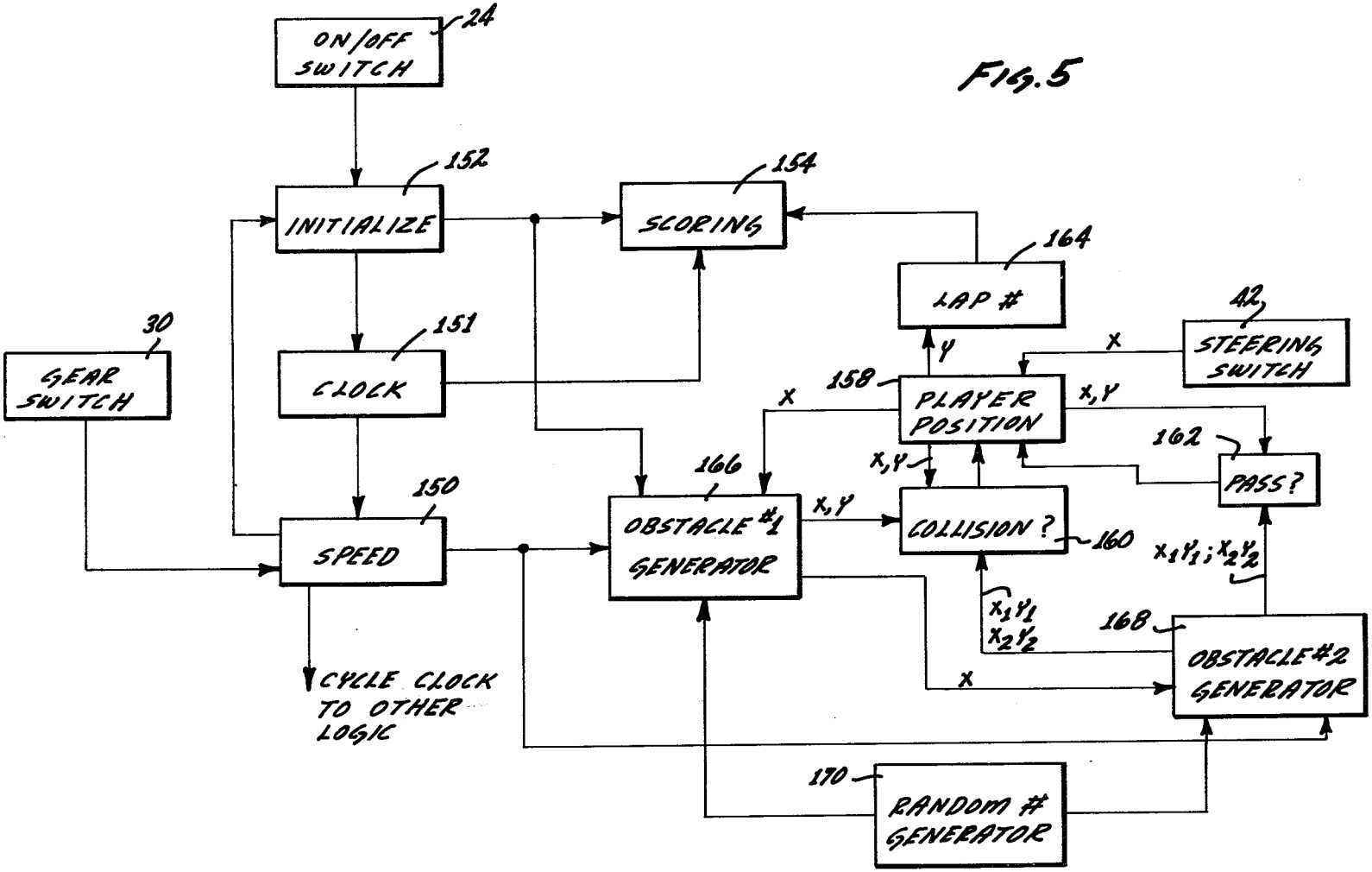
FIG. 5 is a block diagram schematic of the electronic logic contained within the game of FIG. 1.

DETAILED DESCRIPTION OF THE PREFERRED EMBODIMENTS:

Referring now specifically to FIG. 1, it may be seen that according to the present invention there may be readily constructed an auto race game 10 that may be of a size such that it may be readily held by a human hand 12. The front panel of this game comprises a playing field display 14 divided into three lanes, lane one 16, lane two 18 and lane three 20 as well as a two-digit scoring area 22. The display itself comprises a plurality of light emitting diode segments (thirty-five in number as will be more clear hereinafter with reference to FIG. 3) with the various segments being covered by a red plastic material through which the activated elements may be visible; the plastic preferably has a molded-in magnifier in the vicinity of scoring area 22 in order that the score may be more readily visible to the player. The front panel is also provided with a first switch 24 having a "reset" position 26 and a "start" position 28, and a second switch 30 having a first gear position 32, a second gear position 34, a third gear position 36 and a fourth gear position 38. As shown in the figure first switch 24 is shown in "start" position 28 and second switch 30 is shown in fourth gear position 38. The front panel is also provided with a speaker grille 40 underneath which is a miniature speaker of approximately one inch in diameter (not shown) for the purpose of providing audio signals to the player signifying the running of the car's motor (with a higher frequency sound signifying a higher gear), the occurrence of a collision, and the successful or unsuccessful completion of the race.

In addition to switches 28 and 30, the operator playing the game also has available to him a third switch 42 which slides from side to side thereby controlling the placement of the indicia signifying the player's car in either first lane 16, second lane 18 or third lane 20.

Inasmuch as first switch 24 is used only to initiate the start of the race, in normal use one finger or thumb of one of the operator's hands control the position of third switch 42 (and thus the position of the indicia indicating the operator's vehicle) and a finger or thumb of his other hand controls second switch 30, the gear selector switch, which as will become more clear hereinafter, controls the rate at which obstacles proceed toward the operator's vehicle indicia and which therefore creates the illusion of a higher or lower rate of speed along the auto raceway. This illusion is heightened by the provision of sound of appropriate frequency emanating through speaker grille 40.

In operation the human player races his car up the track avoiding collisions with oncoming cars. Once he has completed four laps (advanced from the bottommost rung into the topmost rung) four times in ninety-nine seconds or less, he has successfully completed the race and the elapsed time to complete four laps is permanently displayed in score area 22, until the game is turned off.

In order to initiate the race, switch 30 is set into first gear position 32 and switch 24 is moved from reset position 26 to start position 28. The user's car is then simulated by a bright blip of light that appears on the bottommost rung of track 14 in the lane selected by lane selector switch 42, and obstacles simulating opponents' car generated by the internal workings of the game start at the topmost rung and move down to the bottom. The user steers his car from lane to lane by means of steering control 42, steering either right or left to avoid a collision with an oncoming car. The position of the user's car must be in one of the three lanes at any given time, and one of the lanes is always open.

If a collision occurs between the user's vehicle and one of the oncoming cars, the operator is penalized by his vehicle being moved (one rung at a time) back to the starting rung, and thus he loses valuable time. In order to avoid such a possibility (or if a collision cannot be avoided and has already occurred), the user's car should be switched to a free driving lane quickly to minimize the number of rungs which it may be driven back and the resultant time penalty.

After one lap has been completed and the blip of light signifying the user's car has advanced to the topmost rung, it automatically returns to the bottommost rung ready for the next lap which proceeds in the same manner. Once four laps have been completed in ninety-nine seconds or less, a beeping sound signifying victory emanates through speaker grille 40 and the total elapsed time is displayed in area 22. If, on the other hand, ninety-nine seconds has elapsed since the start of the race and four laps have not been completed, the digits 99 remain in area 22 and a monotone sound of defeat emanates through speaker grille 40 until the game is turned off by means of switch 24.

Inasmuch as gear selector switch 30 may be set to any one of the four positions once the race has started, it is advantageous to shift to a higher gear to gain valuable time and to decrease the total elapsed time to complete the four laps. On the other hand, shifting to too high a gear, especially in the vicinity of the uppermost rungs reduces the reaction time to prevent the user's vehicle being penalized back to the starting line (the lowermost rung).

From the above description of one embodiment of the present invention and the manner in which the user controls the game, it may be seen that the user may either race against himself (trying to beat his previous best time for the completion of the race) or may race against an opponent, in which case the person completing the race in the shortest elapsed time is the winner.

The timing of the circuitry is preferably adjusted such that if the user's car is left in first gear, almost the full ninety-nine seconds is required to complete the race and even one collision may be sufficient to cause ninety-nine seconds to elapse before the completion of the full four laps. On the other hand, in fourth gear it should be possible to complete the entire race in less than 30 seconds if one is successful in avoiding all collisions; while the average player will normally utilize several gears and complete the race in somewhat over fifty seconds. Obviously the greatest play value of such a game results when it is virtually impossible to make a perfect score, but there is such a wide range of possible scores that the user will note a significant increase in his score as he gains proficiency.

There is also an element of luck involved inasmuch as there is no way for the user to know ahead of time in which lanes the opposing car obstacles will appear until they are shown on the topmost rung. Thus, even a perfect player will occasionally be outwitted, especially when he has moved his car close to the topmost rung.

Referring now to the partially exploded perspective view of FIG. 2, the side and rear portions of the game illustrated in FIG. 1 comprise a back panel 50 provided with a battery hatch 52 covered by a removable battery cover 54 in which a nine-volt transistor battery 56 may be securely located and connected to the miniaturized electronic circuitry inside the game by means of a conventional battery attachment plug 58 connected to said circuitry by a short cable 60.

Referring now to FIG. 3 representing in schematic form the LED segments forming lanes 16, 18, and 20 of playing field 14, as well as the two scoring digits of scoring area 22, it may be seen that lowermost rung 70 comprises a first segment 72 in first lane 16, a second segment 74 in second lane 18, and a third segment 76 in third lane 20. Second rung 78 comprises first lane segment 80, second lane segment 82 and third lane segment 84. Third rung 86 comprises first lane segment 88, second lane segment 90 and third lane segment 92. Fourth rung 94 comprises first lane segment 96, second lane segment 98 and third lane segment 100. Fifth rung 101 comprises first lane segment 102, second lane segment 104 and third lane segment 106. Sixth rung 108 comprises first lane segment 110, second lane segment 112, and third lane segment 114; while seventh rung 116 comprises first lane segment 118, second lane segment 120 and third lane segment 122.

Although the embodiment illustrated shows three lanes and seven rungs, it may be appreciated that the invention may also be practiced with more than three lanes and with more or less than seven rungs. As a practical matter, in order to provide adequate play value, there should be at least five rungs; while it has been found that providing more than seven rungs does not significantly increase the play value, especially since in comparison additional electronic logic may be readily provided to automatically move the indicia from the last rung back to the first rung once the ladder has been successfully climbed (or the lap completed).

Also visible in FIG. 3 are two seven-segment digital display elements, the more significant digit (the tens digit) being indicated generally by reference numeral 124, while the least significant digit (the units digit) is indicated generally by the reference numeral 126.

These various segments may be addressed by conventional multiplex electronic addressing means, not shown, the individual segments each having an X driver and a Y driver.

For the simplicity of addressing logic, the first lane segment (such as first rung, first lane segment 72) may be thought of as the A segment (the segment which would normally display the horizontal line for the numeral 7); of a first digit the second lane segment (such as the second lane segment 74 of first rung 70) may be thought of as the G segment of the first digit (the segment indicating the middle horizontal line of the numeral 5) while the third lane segment (such as third lane segment 76 of first rung 70) may be thought of as the D segment of a seven-segment digit (that is the bottommost horizontal line in the numeral 3). The segments comprising first rung 70 may be then addressed as though they comprised the A, G and D segments of the first digit, the segments of second rung 78 the respective segments of a second digit and so on for the respective segments 118, 120 and 122 of seventh rung 116 which may be thought of as comprising segments of a seventh digit, while tens scoring digit 124 may be thought of as an eighth digit and units scoring digit 126 may be thought of as a ninth digit.

FIG. 4 shows a second embodiment of the display of FIG. 3 which is actually a standard eight-digit display used in low-cost calculators. The six most significant digits namely the most significant digit 130, second most significant digit 132, third most significant digit 134, fourth most significant digit 136, fifth most significant digit 137 and sixth most significant digit 138 comprise the six rungs of a playing field and only the A, G and D segments thereof are utilized; while all seven segments of least significant digit 140 and of second least significant digit 141 are utilized to display a two digit score.

Another simple modification to the standard drive circuitry utilized in multiplex addressed seven-segment digit displays is to distinguish the user's car indicia from the opposing obstacle indicia by providing a 4:1 player-/obstacle duty cycle ratio, thereby resulting in the user's car being shown as a much brighter blip than those representing the obstacle.

Referring now to FIG. 5 wherein the control circuitry for the first embodiment (the auto race game) of the present invention is disclosed and shown in block diagram schematic form, it may be seen that the circuitry is provided with a speed circuit 150 responsive to conventional electronic clock generator 151 which provides a signal representative of the basic timing unit known as a "cycle", two cycles comprising one "dwell", although connections are not always shown from the circuit 150 to the various other blocks of the diagram, it should be understood that all blocks are under its control, some blocks being responsive to the first cycle of a dwell, some blocks being responsive to the second cycle of a dwell, and some blocks being responsive both the first and second cycles, as will become more clear hereinafter. As a general rule the first cycle within a dwell is used by the other blocks to generate signals representative of the new positions of the player's piece and of the abstacles, while the second cycle within a dwell is used to determine whether or not the positions of the various pieces thus generated result in a "collision" and/or the successful completion of a lap, in which case appropriate flags are set which are also used by the sound generation circuitry (not shown).

Reset-start switch 24 when moved into the "start" position causes initialization circuitry 152 to generate an initialization signal which resets scoring circuitry 154 to zero, provided that speed selector switch 30 is set in the first gear position.

Scoring circuitry 154 generates the output to display 22 and is so designed that said display increments one digit approximately every second; however, it should be noted that extreme accuracy in this regard is not required, but rather what is required is repeatable performance from one run of the game to the next. Scoring circuitry 154 also provides an output to the sound circuitry inasmuch as the sound circuitry is arranged to provide a win-or-lose signal upon the successful or unsuccessful completion of the game and motor sounds are thereafter inhibited.

The circuitry responsible for the generation of the signal representative of the position of the player is indicated by the numeral 158 and is responsive to steering control switch 42 which determines in which lane the player's piece is to be displayed; however, player position circuitry 158 generates internally a second signal representative of the rung in which the player is located, based on an algorithm which is a function of whether or not a collision has occured in the previous dwell (the collision determination circuitry being generally indicated by the numeral 160) or whether or not the player's piece has been successfully passed without collision by the second obstacle of an obstacle pair (the pass determination circuitry being indicated by the numeral 162).

Inasmuch as the game requires the successful completion of more than one lap, there is also provided a lap counter 164. At the successful completion of a lap, the player's piece is returned back to the first rung after a delay of one cycle. Once lap counter 164 registers the successful completion of four laps, an appropriate signal inhibits the further running of the scoring clock 154 and an appropriate signal is sent to the sound circuitry for generation of an audible win signal.

The key to the interest provided by this game, despite its simplicity and portable nature, is in the obstacle circuitry with the number one obstacle being generated by circuitry 166 and the number two obstacle being generated by circuitry 168, both being connected to a random or pseudo-random number generator 170. At this point it should be noted that it has been determined experimentally that generation of obstacles in pairs (occupying therefore at most two of the three available lanes) provides a challenging yet interesting game, and never results in a situation in which it is theoretically impossible to achieve a perfect score if the player is sufficiently skillful. On the other hand it has been found that each time a pair of obstacles appears, some positive reaction by the user should be required otherwise he will lose interest. Thus, the first obstacle in a pair always appears in the lane then being occupied by the player, while the second obstacle in a pair may appear in any one of the three lanes, either simultaneously and in the same rung as the first obstacle or delayed behind it by a randomly determined amount. If the circuitry has determined that the second obstacle should be in the same lane as the first obstacle then it is preferable to always delay it behind the first obstacle by at least one rung or one dwell.

Thus, the first obstacle generator 166 generates a signal indicative of the lane in which the player was located at the time of generation and regularly advances the first obstacle from the seventh rung to the first rung at the rate of one rung per dwell time. Thus, if the player is located in the first rung at the start of the game, he has seven dwell times in which to move out of the path of the oncoming obstacle. On the other hand, if he is already in the sixth rung, he has only one dwell time in which to get out of the way of the oncoming obstacle. As soon as the first obstacle has arrived at the first ring, a new first obstacle is then generated at the seventh rung according to the same rules in the next dwell period.

Simultaneously with the generation of a new first obstacle, a signal is sent to the second obstacle generator 168 which generates a new second obstacle, in accordance with the same general procedure, but in a randomly selected lane and lagging behind the first obstacle by a randomly generated number of dwell periods.

From the above it may be seen that it is possible for three obstacles to appear on the display at any given time. The second obstacle of an old obstacle pair, the first obstacle of a new obstacle pair and the second obstacle of said new obstacle pair, but only if the lag between the two obstacles in the new pair is less than that in the old pair. Thus, second obstacle generation circuit 168 must be designed such that it is capable of keeping track of two obstacles at any given time. Alternatively it would be possible to design an alternative to circuit 168 such that the generation of the second obstacle of the new obstacle pair is inhibited until the second obstacle of the old obstacle pair has disappeared from the display.

Collision circuitry 160 is responsive to signals from player position circuitry 158 indicative of the player's position (both its position representing which lane and its Y position representing which rung) as well as obstacle number one's position (both X and Y components) and to the position of the obstacles generated by second obstacle generator circuit 168 (both their X and Y positions). If collision circuit 160 determines that a collision has taken place between the player and one or another obstacles, it generates a signal to player position 158 which causes the player's Y coordinate (its rung number) to be reduced by one during the next cycle, unless it is already located on the first rung.

Pass circuitry 162 is responsive to signal indicative both of the players' positions and that of second obstacles. If both the player and the second obstacle are in the same rung, but in different lanes, then a successful pass signal is generated to player's position circuitry 158, and the player's piece is advanced one rung toward the finish line unless a collision with a first obstacle has occurred during the same dwell.

Although not shown explicity in FIG. 5, the sound generation circuitry has been functionally defined above and it can be readily seen that signals from clock circuit 150 and speed circuit 150 may be suitably modulated to provide a low frequency signal to a speaker simulating the running of a motor at different speeds, and that suitable signals generated by collision circuit 160 and scoring circuit 154 may inhibit the generation of motor sounds, replacing them with "collision" sound (for example a steady bleep of fixed duration) or "win" sounds (for example a warbling high frequency sound), while lap counter 164 can generate a signal that inhibits all sound at the end of the lap thereby giving an audible indication that a new lap has begun.

While the above circuitry has been discussed with particular reference to one preferred embodiment of the present invention, it should be readily apparent that many variations therein are possible. For example, the pass logic could be responsive to the first obstacle or to some function of both obstacles; the player's forward motion could be a function only of time and motor speed and independent of the location of any obstacle. On the other hand, a collision could result in a penalty other than a backwards motion by one rung (for example, return to start or return to the beginning of a lap); furthermore, a collision could result in but a single rung penalty, regardless of whether or not the player moves out of the way of the obstacle before the start of the next dwell.

Further modifications to this embodiment and improvements will doubtless be readily apparent to those skilled in the art.

While not believed necessary for a thorough understanding of the present invention, submitted herewith and made a permanent part of the file wrapper of this application is a computer program listing showing how a conventional computer may be programmed to simulate the various functions of the above described circuitry and drive a conventional LED digital display to the extent that this material is deemed by the Examiner to be necessary under the provisions of § 112 of the Patent Laws, it is incorporated herein by reference.

FIG. 6 shows a second embodiment of the present invention, namely, a football game which is especially adaptable for play by two players, the first player being responsible for the plays of the home team and the second player being responsible for the plays of the visitor team. The game is indicated generally by the reference numeral 200 and it may be seen that it comprises a playing field area 202, a scoreboard area 204, a set of player controls 206 and a set of game controls 208. Playing field 202 and scoreboards 204 are shown more clearly in FIG. 7. To heighten the illusion of a football field, playing area 202 is surrounded by a simulated grandstand 210 and scoreboard 204 if "built-in" said grandstand. The game simulates a broken field run by a running back. The object of the game is for the running back to evade the tackles and advance to score a touchdown.

Inasmuch as the operation and implementation of this second embodiment is substantially similar to that to the first embodiment described in detail above, the description which follows will be relatively cursory in nature.

The progress and results of the game is shown on field display 202 and score display 204. At the start of the game, field display 202 positions the player at the leftmost rung in the center lane (unlike the race game described above, this game utilizes nine rungs but still retains three lanes; the rungs represent yardage along the length of a football field and the lanes represent position on a given yard line either center, right or left. Three tackles are initially located on the fourth rung, with additional single tackles being located in the centers of the sixth rung and of the ninth rung. The position of the player is controlled by player controls 206, with control 212 moving the player to the left, (assuming that play commences with the player on the lefthand portion of the screen) control 214 moving the player one lane to the right and control 216 advancing the player forwards. The bidirectional nature of the arrow indicated on switch 216 is occasioned by the fact that, when control of the ball passes to the other player, the motion of the player is then in the opposite direction (that is, from the ninth rung to the first rung). Since, in this embodiment of the game, the player is free to determine not only the side-to-side motion of his piece but also the speed at which it is advanced, it is necessary for the obstacle generation logic to take into account both the distance between the player and the obstacle and also the X and Y directions. Furthermore, the various tackles must never occupy the same space. Thus, the strategy of the player is to draw all the tackles to one side, open a passage on the opposite side, and use this passage to move across the display. Each rung on the display is scored as one yard and advancing past the last rung moves the player back to the first rung, so that he may score even more than ten yards in a single play. Play of a particular run continues until a player has been tackled or until he scores a touchdown. He has four chances to gain ten yards. If he manages to do so, the game is reset to first down. If not, the game is reset to a mirror image of the above described starting position and play is resumed by the opponent. Two modes of score display 204 are possible: a score mode showing the number of points for the home team, the visitor team, and the time remaining; and a status mode, indicating which down, the position on the field, and the number of additional yards required to score a new first down. A touchdown is credited with seven points.

Again as was the case for the automobile race game the LED segment indicating the player's position is four times as bright as that of the obstacles or tackles. The player control switches 208 are momentary "on" switches, with debounce incorporated if necessary. A play status switch 218 when depressed causes the above described status to be displayed on display 204, while score switch 220 when depressed causes the above described score to be displayed. There is also provided a punt switch 222 which may be used in a fourth down to cause a punt of a random number of yards to be generated prior to turning over control to the apponent.

A speaker is located behind a speaker grille 224 and audio signals representative of the loss of the ball (for example a double whistle), the tackling of the player (for instance a single whistling), the successful completion of ten yards, the end of a quarter, a touchdown (which may be in the form of a cheer or melody), and the ticking of the game clock (while play is in progress).

In addition to the features of the game briefly described above, other options will be apparent to those skilled in the art, for instance, the provision of a field goal capability of a kick run back.

Furthermore, the game may be provided with a skill selector switch analogous to the gear selector of the race game, which would increase the speed of the motion of the tackles advancing toward the player and thus better challenging an experienced player.

Although the invention has been described above in considerable detail with reference to several possible embodiments, it should be appreciated that the scope of the invention should be determined solely with reference to the following appended claims.

What is claimed is:

1. An electronic game comprising:

a display having segments operable within a playing field of at least three lanes and at least six rungs per lane, each of said segments being illuminatable for displaying indicia representative of the location of a player's piece and also that of obstacles;

means for moving the player's piece indicium from one lane of the field to another lane of the field in response to a manual input;

means internal to the game for automatically advancing the obstacle indicia on the playing field towards the player's piece indicium;

means for providing a predetermined algorithm; and means for automatically determining whether or not the player's piece indicium and an obstacle indicia have collided, and, if a collision has occurred, for then automatically moving said player's piece indicium back one rung in response to the collision in accordance with said predetermined algorithm.

2. The game of claim 1 further comprising means for determining whether or not said player's piece indicium has successfully passed an obstacle and, if so, then advancing said indicium by one rung.

3. The game of claim 2 wherein said obstacles are generated in pairs having a randomly variable separation in the rung (Y) direction.

4. The game of claim 3 wherein the game further comprises:

a lap counter whereby games of more than one lap from the first rung to the last rung may be played; and a scoring display for indicating the total time required to negotiate a given number of laps.

5. The game of claim 2 further including manually operable means for controlling the rate at which obstacle indicia advance toward the player's piece indicium.

6. The game of claim 1 wherein said algorithm results in the stopping of a clock provided as part of said game.

7. An electronic game comprising:

a display having segments operable within a playing field of at least three lanes and at least six rungs per lane, each of said segments of each of said lanes being in aligned relation and each of said segments within a rung being in aligned relation, each of said segments being illuminatable for displaying indicia representative of the location of a player's piece and also that of obstacles;

means for moving the player's piece indicium one lane at a time from one lane of the field to nother lane of the field in response to each actuation of a manual input;

means for incrementing the player's piece indicium one rung at a time to another rung in the same lane in response to each actuation of the manual input;

means internal to the game for automatically advancing the obstacle indicia on the playing field toward the player's piece indicium;

means for providing a predetermined algorithm;

means for automatically determining whether or not the player's piece indicium and an obstacle indicia have collided, and, if a collision has occurred, for then automatically terminating the play in progress in accordance with said predetermined algorithm;

means internal to the game for determining "yardage" traversed by the player's piece indicium as a function of the number of rungs incremented; and means responsive to another manual input for displaying time remaining to the end of a game "period" and also "yardage".

8. The combination according to claim 7 wherein said game further includes clock means operable in response to the initial movement of the player's piece indicium, said clock means terminating in response to a collision and said means for displaying time remaining to the end of a game "period" is altered by said predetermined algorithm in accordance with said clock means.

* * * * *

UNITED STATES PATENT OFFICE

CERTIFICATE OF CORRECTION

Patent No. 4,162,792 Dated July 31, 1979

Inventor(s) Richard Shih-Teng Chang, et al

It is certified that error appears in the above-identified patent and that said Letters Patent are hereby corrected as shown below:

Col. 1, line 50, change "do" to --does--; Col. 1, line 52, change "games" to --game--. Col. 2, line 14, after "piece" insert a comma (--,--); Col. 2, line 17, prior to "suitable" insert --and with--. Col. 3, line 55, change "into" to --to--. Col. 5, line 48, delete the semi-colon (";"); Col. 5, line 48, after "digit" insert a comma (--,--); Col. 5, line 52, insert a comma (--,--) before "while"; Col. 5, line 59, change "for" to --up to--. Col. 6, line 23, change the comma (",") to a semi-colon (--;--); Col. 6, line 29, before "both" insert --to--. Col. 7, line 60, change "time. The" to --time: the--. Col. 8, line 17, change "signal" to --signals--; Col. 8, line 33, change "sound" to --sounds--. Col. 9, line 11, change "if" to --is--; Col. 9, line 27, after "left" insert --)--. Col. 10, line 46, change "an obstacle indicia" to --an obstacle indicium--; Col. 10, line 53, after "obstacle" insert --indicium--; Col. 10, line 55, change "obstacles" to --obstacle indicia--. Col. 11, line 16, change "nother to --another--; Col. 11, line 17, before "manual" insert --first--; Col. 11, line 23, change "the" to --a second--. Col. 12, line 6, change "indicia" to --indicium--; Col. 12, line 13, delete "responsive to another manual input".

Signed and Sealed this

*Thirteenth* Day of *May 1980*

[SEAL]

*Attest:*

SIDNEY A. DIAMOND

*Attesting Officer* *Commissioner of Patents and Trademarks*